US006322432B1

(12) United States Patent
Wang

(10) Patent No.: US 6,322,432 B1
(45) **Date of Patent: *Nov. 27, 2001**

(54) SANDER ASSEMBLY HAVING ADJUSTABLE WORKING TABLE

(76) Inventor: Tian Wang Wang, No. 45, Yi Chang East Road, Taiping City, Taichung Hsien (TW), 411

( * ) Notice: Subject to any disclaimer, the term of this patent is extended or adjusted under 35 U.S.C. 154(b) by 0 days.

This patent is subject to a terminal disclaimer.

(21) Appl. No.: 09/723,050

(22) Filed: Nov. 27, 2000

(51) Int. Cl.[7] ..... B24B 41/00
(52) U.S. Cl. ..... 451/361; 451/296
(58) Field of Search ..... 451/188, 182, 451/178, 207, 131, 130, 331, 358, 545, 914, 177, 296, 305, 361, 360, 411; 125/35

(56) References Cited

U.S. PATENT DOCUMENTS 3,718,168 * 2/1973 Berends ..... 144/129
3,888,049 * 6/1975 Macsween ..... 451/361
5,582,539 12/1996 Wang ..... 451/188
5,988,239 * 11/1999 Chen ..... 144/129
6,106,388 * 8/2000 Green ..... 451/65
6,146,254 * 11/2000 Wang ..... 451/65

* cited by examiner

*Primary Examiner*—Derris H. Banks
(74) *Attorney, Agent, or Firm*—Charles E. Baxley

(57) ABSTRACT

A sander includes a sander device supported above a base, and a working table for moving the work pieces up and down relative to the sander device. The working table has one or more poles and one or more bolts threaded with the poles to stably move the poles up and down when the bolts are rotated by a hand wheel. The sander device includes two wheels rotatably supported above the base, a sander belt engaged over the wheels, and a spring biasing the wheels away from each other to tighten the sander belt. An eccentric weight may vibrate and calibrate the sander belt.

17 Claims, 5 Drawing Sheets

SANDER ASSEMBLY HAVING ADJUSTABLE WORKING TABLE

BACKGROUND OF THE INVENTION

1. Field of the Invention

The present invention relates to a sander assembly, and more particularly to a sander assembly having a working table that may be adjusted up and down relative to an upper sander device to move the work pieces upward toward or downward away from the upper sander device.

2. Description of the Prior Art

Typical sanders comprise one or more sander wheels or the like rotatably supported on a fixed table. The workers have to move the work pieces across the table and to move the work pieces relative to and toward and away from the sander wheels in order to sand the work pieces with the sander wheels.

The applicant has developed a different sander disclosed in U.S. Pat. No. 5,582,539 to Wang and having a sander wheel provided above the working table and movable upward and downward toward the working table to sand the work pieces disposed on the working table. However, a complicated configuration is required to be provided for moving the sander wheel upward and downward relative to the working table.

The present invention has arisen to mitigate and/or obviate the afore-described disadvantages of the conventional sanders.

SUMMARY OF THE INVENTION

The primary objective of the present invention is to provide a sander assembly including a working table that may be adjusted up and down relative to an upper sander device to move the work pieces upward toward or downward away from the upper sander device.

In accordance with one aspect of the invention, there is provided a sander assembly comprising a base, a sander device provided above the base, a working table slidably supported between the base and the sander device for supporting work pieces to be sanded thereon, and means for moving the working table toward and away from the sander device.

The working table includes one or more poles extended downward therefrom and slidably engaged in the base. The moving means includes one or more bolts rotatably received in the base and threaded with the poles respectively to move the poles relative to the base when the bolts are rotated relative to the poles and the base. The bolts are coupled together by a shaft and rotated in concert with each other.

A rotating device is further provided for rotating the bolts and includes a hand wheel rotatably secured to the base and coupled to the bolts for rotating the bolts. The poles each includes an extension extended therefrom and threaded with the bolts for allowing the poles to be moved up and down by the bolts when the bolts are rotated relative to the poles respectively.

The sander device includes a first wheel rotatably supported above the base, and means for driving the first wheel and having a motor, and means for coupling the motor to the first wheel and to driven the first wheel.

The base includes a post extended upward therefrom, the sander device includes a frame secured on the post, the first wheel is rotatably supported in the frame with an axle.

The sander device further includes a second wheel rotatably provided above the first wheel, and a sander belt engaged over the first and the second wheels. A biasing device is further provided for biasing the first wheel and the second wheel away from each other to tighten the sander belt. Another device is further provided for vibrating the second wheel and the sander belt.

The sander device includes a bracket for rotatably supporting the second wheel with a spindle, and the vibrating means includes an eccentric weight rotatably supported in the bracket and coupled to the spindle for being rotated by the spindle to generate and provide a vibration to the bracket and the second wheel and the sander belt.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
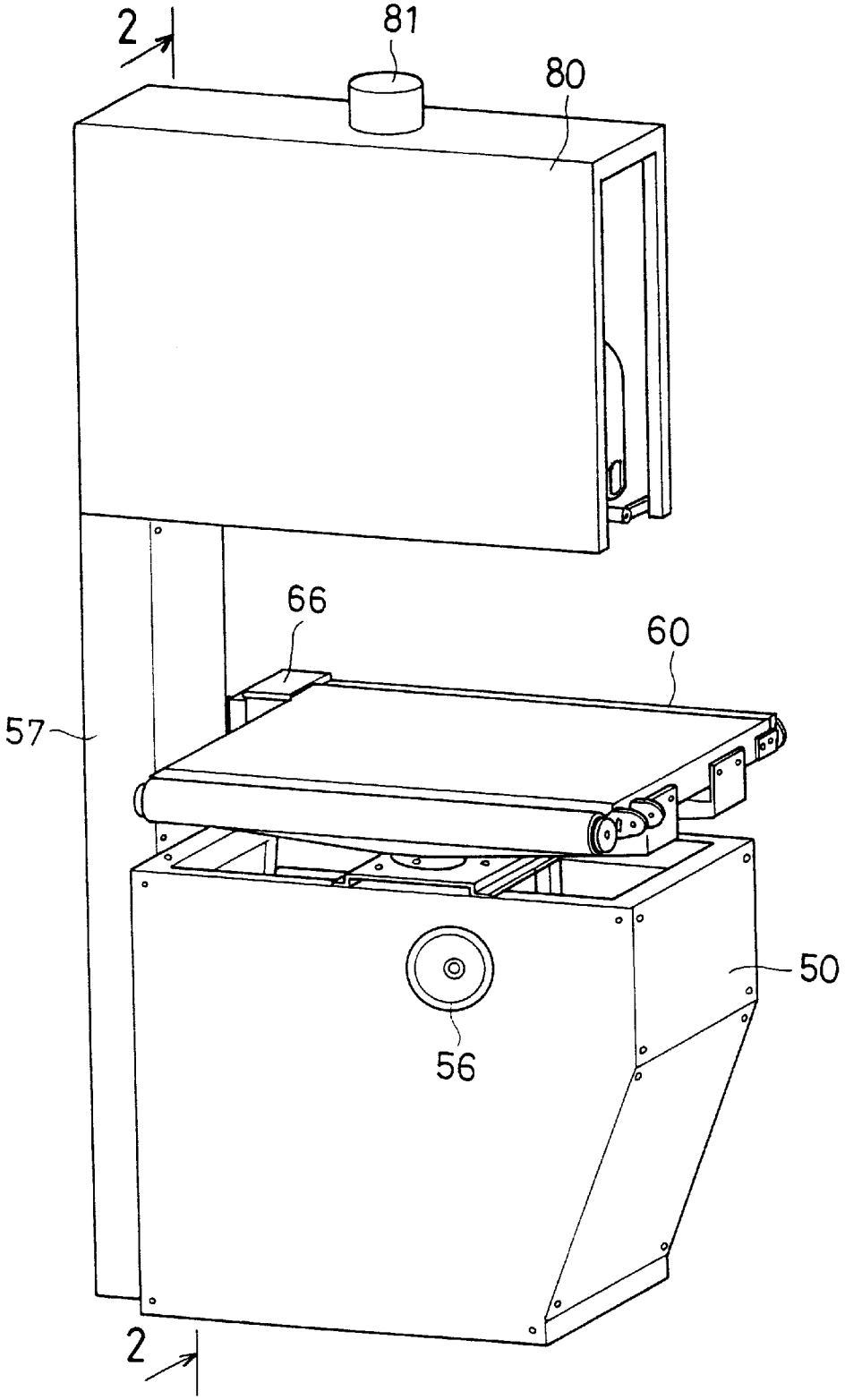
FIG. 1 is a perspective view of a sander assembly in accordance with the present invention.
Figure 2:
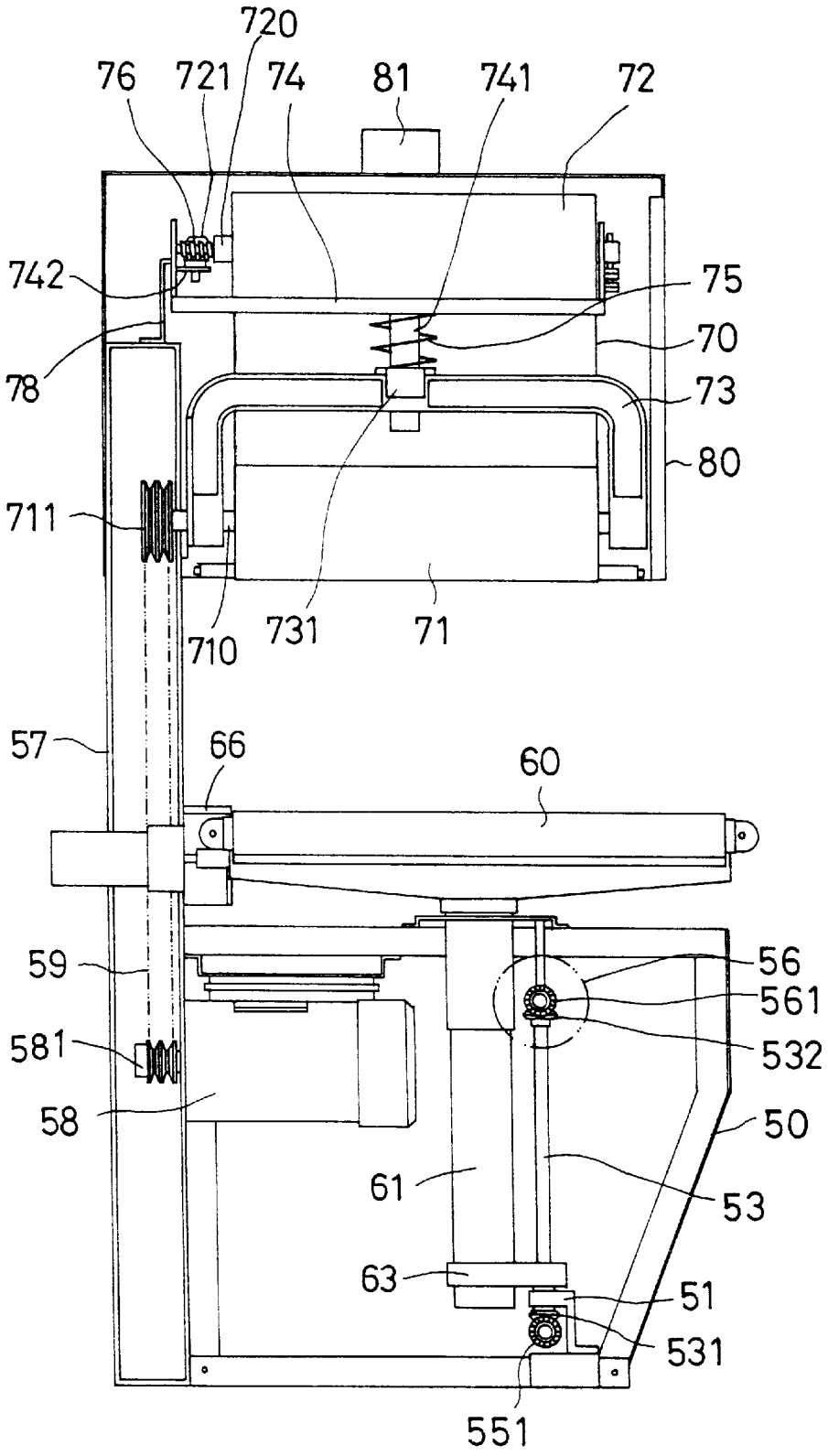
FIG. 2 is a partial cross sectional view taken along lines 2—2 of FIG. 1.
Figure 3:
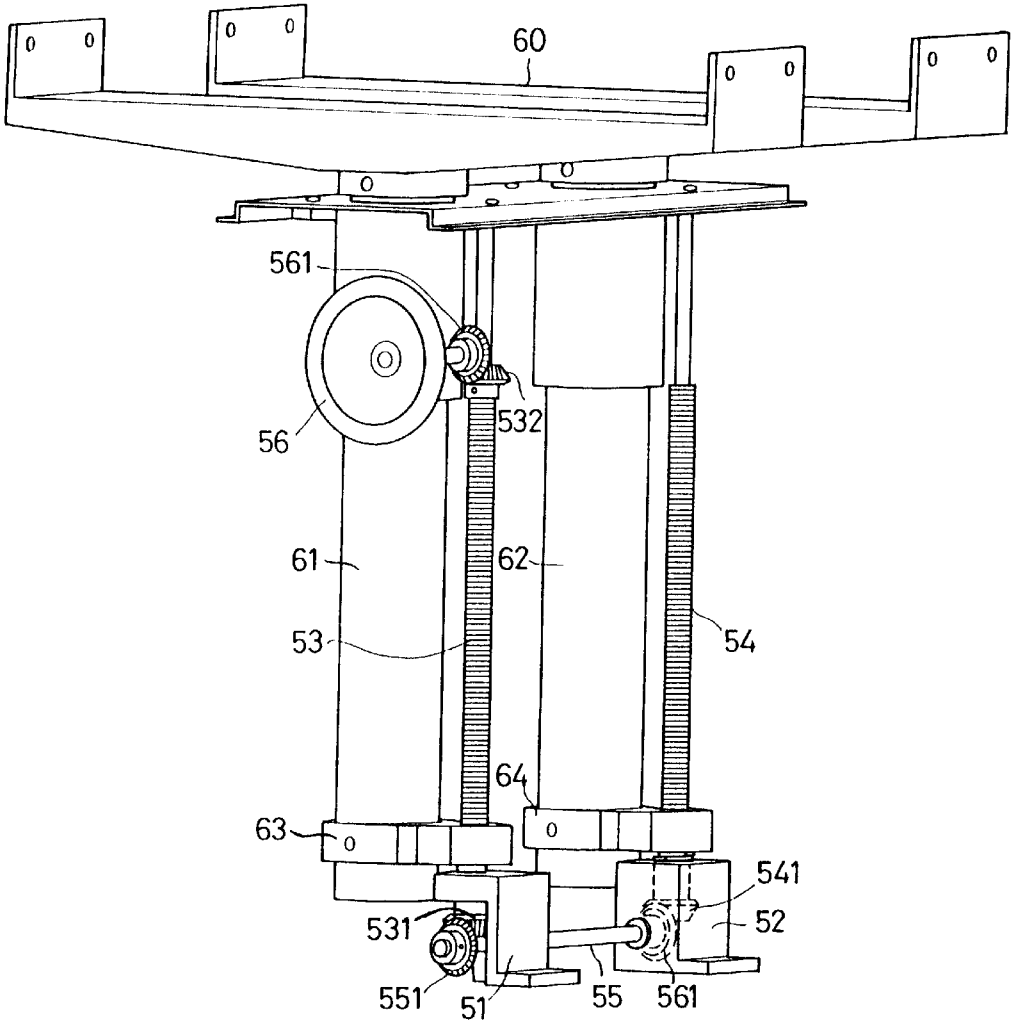
FIG. 3 is an enlarged partial perspective view of the adjusting mechanism for the working table of the sander assembly.

Referring to the drawings, and initially to FIGS. 1–3, a sander assembly in accordance with the present invention comprises a base 50, a post 57 extended upward from the rear portion of the base 50, and a housing 80 secured on top of the post 57 and located above the base 50 for receiving a sander device therein. A working table 60 is slidably provided between the base 50 and the housing 80 for supporting the work pieces to be sanded and for moving the work pieces upward toward and downward away from the sander device provided in the housing 80. The working table 60 may be slidably coupled to the post 57 with a frame or a bracket 66 or the like and with bearings. The working table 60 includes one or more poles 61 extended downward therefrom and slidably engaged in the base 50 and movable up and down relative to the base 50 for guiding the working table 60 to move up and down relative to the base 50. The housing 80 includes an outlet 81 coupled to a vacuum device for drawing and vacuuming the sanded dirt out of the housing 80.

One or more seats 51, 52 are disposed in the base 50. One or more bolts 53, 54 are rotatably received and secured in the base 50 and rotatably supported on the seats 51, 52 respectively, and each includes a bevel gear 531, 541 attached or provided on the bottom thereof. A shaft 55 is rotatably supported between the seats 51, 52 and includes two ends each having a bevel gear 551, 561 attached or provided thereon and engaged with the corresponding bevel gears 531, 541 of the bolts 53, 54 respectively, such that the bolts 53, 54 may be coupled together with the shaft 55 and may be rotated in concert with each other. The poles 61, 62 each includes a portion, such as an extension 63, 64 extended therefrom or attached thereto and threadedly engaging with the bolts 53, 54, such that the poles 61, 62 and thus the working table 60 may be moved up and down relative to the base 50 by rotating the bolts 53, 54. One of the bolts 53 includes a bevel gear 532 provided on the upper portion thereof. A hand wheel 56 is rotatably secured to the base 50 and includes a bevel 561 secured thereto and engaged with the bevel gear 532 in order to rotate the bolts 53, 54 and in order to move the working table 60 up and down relative to the base 50 with the hand wheel 56.

Figure 4:
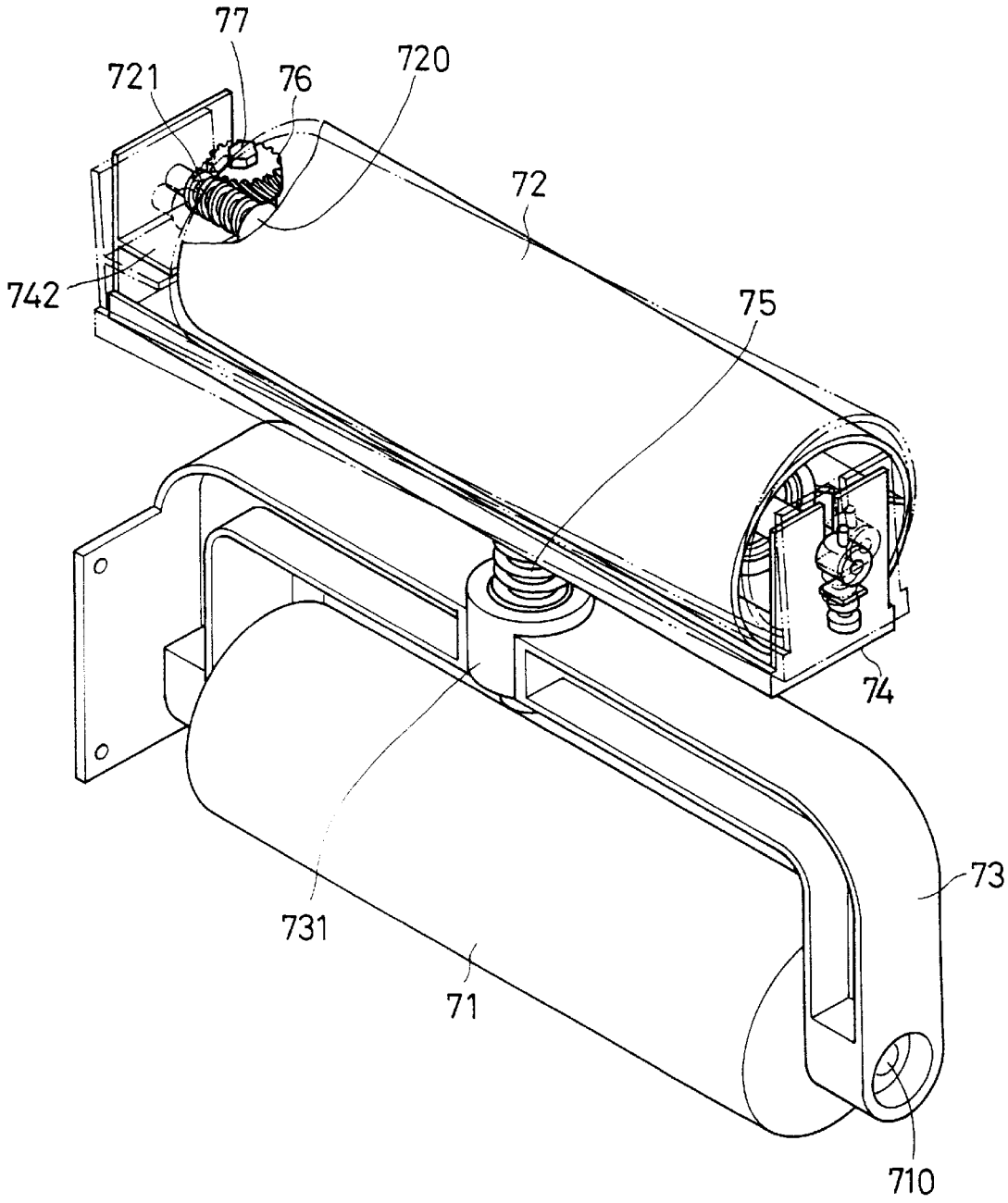
FIG. 4 is a perspective view illustrating the sander belt supporting device.

As shown in FIGS. 2 and 4, an inverted U-shaped frame 73 is secured in the housing 80 or secured to the post 57 and includes a hub 731 provided in the middle portion thereof. The sander device includes a drum or a wheel 71 or even a sander wheel rotatably secured in the frame 73 with an axle 710. A driving device, such as a motor 58 is secured in the base 50 and may be coupled to the wheel 71 with a coupling device, for rotating the wheel 71 and/or the other sanding members of the sander device. For example, the coupling device includes a sprocket or a pulley 581 coupled to the motor 58, and another sprocket or a pulley 711 coupled to the axle 710 of the wheel 71, and a chain or a belt 59 engaged over the pulleys 581, 711, for allowing the motor 58 to rotate the wheel 71.

Figure 5:
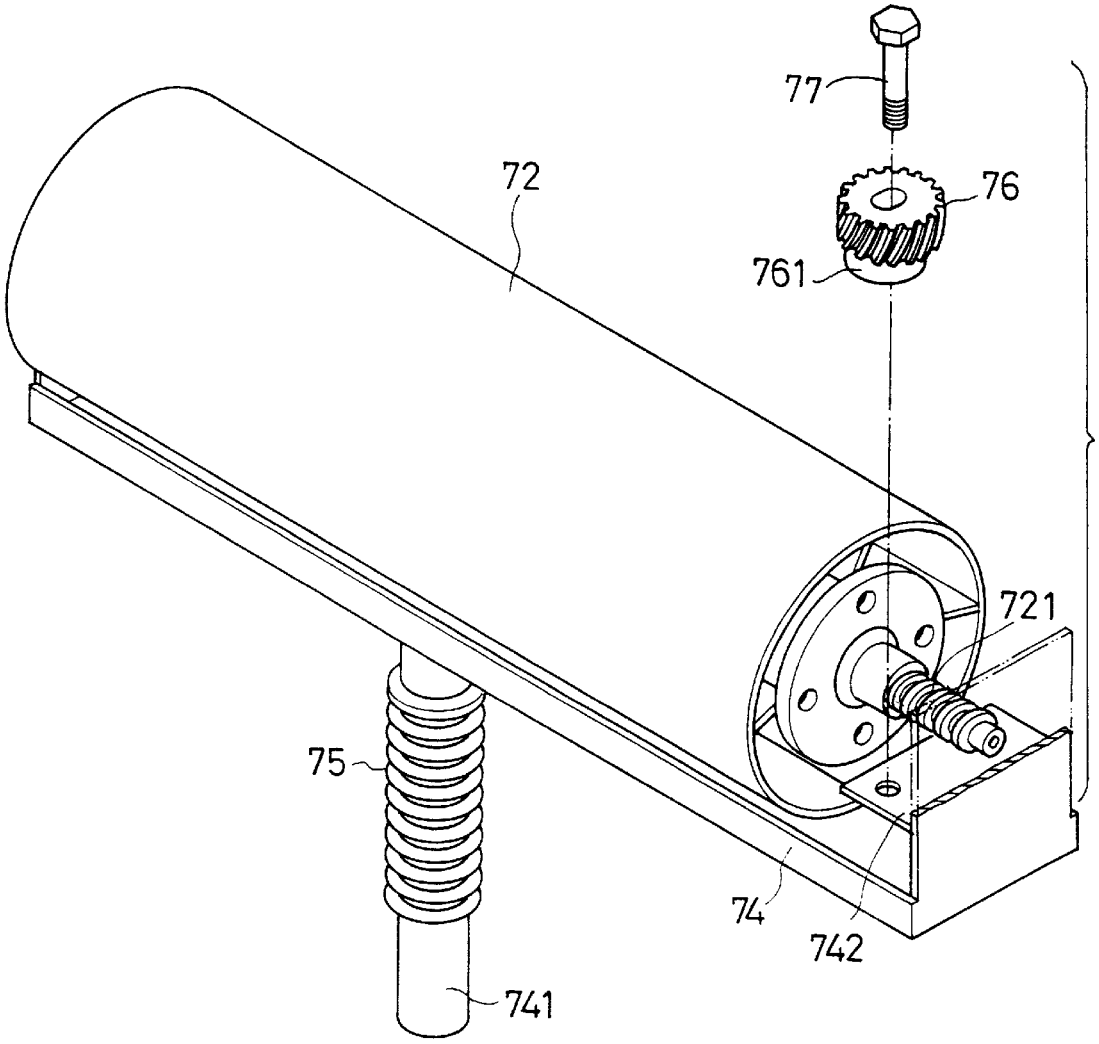
FIG. 5 is a partial exploded view of the vibrating or calibrating device for the sander belt.

As best shown in FIGS. 2 and 4–5, the sander device further includes a bracket 74 slidably received in the housing 80 and provided above the wheel 71, and a rod 741 extended downward from the bracket 74 and slidably received in the hub 731 of the frame 73, in order to guide the bracket 74 to move up and down relative to the frame 73 and the wheel 71. Another drum or wheel 72 is rotatably supported in the bracket 74 with a spindle 720 which has a worm 721 provided thereon. A sander belt 70 (FIG. 2) is engaged over the wheels 71, 72 so as to be rotated by the wheel 71. A spring 75 is engaged on the rod 741 and biased between the bracket 74 and the frame 73 for biasing the bracket 74 and thus the wheel 72 upwardly away from the frame 73 and the wheel 71, and for tightening the sander belt 70.

The bracket 74 includes a panel 742 extended therefrom. A worm gear 76 is rotatably secured in the bracket 74, such as secured in the panel 742 of the bracket 74 with a pin 77 and engaged with the worm 721 and includes a cam or an eccentric weight 761 provided thereon. The eccentric weight 761 of the worm gear 76 may be rotated by the spindle 720 of the wheel 72 in order to generate a vibration to the bracket 74, as shown in dotted lines and solid lines in FIG. 4, for calibrating or centering the bracket 74 and/or the wheel 72 and/or the sander belt 70. The post 57 may include an arm 78 extended therefrom and engaged or contacted with the bracket 74 for guiding the bracket 74 to move up and down relative to the frame 73 and for preventing the bracket 74 from greatly rotating relative to the frame 73 and the wheel 71.

In operation, the wheel 71 may be driven by the motor 58 via the coupling belt 59, such that the sander belt 70 may be rotated or driven by the wheel 71. The sander belt 70 may be tightened by the spring 75 and may be calibrated or centered by the vibration generated by the eccentric weight 761 of the worm gear 76. The working table 60 may be moved upward toward and downward away from the wheels 71, 72 and the sander belt 70 in order to move the work pieces upward toward or downward away from the sander device that is received in the housing 80.

Accordingly, the sander assembly in accordance with the present invention includes a working table that may be adjusted up and down relative to an upper sander device to move the work pieces upward toward or downward away from the upper sander device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sander assembly comprising:

a base, a sander device provided above said base, a working table slidably supported between said base and said sander device for supporting work pieces to be sanded thereon, and means for moving said working table toward and away from said sander device.

2. The sander assembly according to claim 1, wherein said working table includes at least one pole extended downward therefrom and slidably engaged in said base, said moving means is provided for moving said at least one pole of said working table toward and away from said sander device.

3. The sander assembly according to claim 2, wherein said moving means includes a bolt rotatably received in said base and threaded with said at least one pole to move said at least one pole relative to said base when said bolt is rotated relative to said at least one pole and said base.

4. The sander assembly according to claim 3 further comprising means for rotating said bolt.

5. The sander assembly according to claim 4, wherein said rotating means includes a hand wheel rotatably secured to said base and coupled to said bolt for rotating said bolt.

6. The sander assembly according to claim 3, wherein said at least one pole includes an extension extended therefrom and threaded with said bolt.

7. The sander assembly according to claim 1, wherein said working table includes two poles extended downward therefrom and slidably engaged in said base, said moving means is provided for moving said poles of said working table toward and away from said sander device.

8. The sander assembly according to claim 7, wherein said moving means includes two bolts rotatably received in said base and threaded with said poles respectively to move said poles relative to said base when said bolts are rotated relative to said base.

9. The sander assembly according to claim 8 further comprising means for rotating said bolts.

10. The sander assembly according to claim 8 further comprising means for coupling said bolts together.

11. The sander assembly according to claim 1, wherein said sander device includes a first wheel rotatably supported above said base, and means for driving said first wheel.

12. The sander assembly according to claim 11, wherein said driving means includes a motor, and means for coupling said motor to said first wheel and to driven said first wheel.

13. The sander assembly according to claim 11, wherein said base includes a post extended upward therefrom, said sander device includes a frame secured on said post, said first wheel is rotatably supported in said frame with an axle.

14. The sander assembly according to claim 11, wherein said sander device further includes a second wheel rotatably provided above said first wheel, and a sander belt engaged over said first and said second wheels.

15. The sander assembly according to claim 14 further comprising means for biasing said first wheel and said second wheel away from each other to tighten said sander belt.

16. The sander assembly according to claim 14 further comprising means for vibrating said second wheel and said sander belt.

17. The sander assembly according to claim 16, wherein said sander device includes a bracket for rotatably supporting said second wheel with a spindle, and said vibrating means includes an eccentric weight rotatably supported in said bracket and coupled to said spindle for being rotated by said spindle to generate and provide a vibration to said bracket and said second wheel and said sander belt.

* * * * *